United States Patent [19]

Moorehead et al.

[11] Patent Number: 4,745,983

[45] Date of Patent: May 24, 1988

[54] BIT SEAT PROTECTOR DEVICE FOR DRILLING SYSTEMS OR THE LIKE

[75] Inventors: John L. Moorehead, Mentor; Ray H. Shaw, Willowick, both of Ohio

[73] Assignee: Sandvik Rock Tools, Inc., Bristol, Va.

[21] Appl. No.: 942,906

[22] Filed: Dec. 17, 1986

[51] Int. Cl.[4] ..... E21B 17/07; E21B 17/10

[52] U.S. Cl. ..... 175/320; 175/306; 175/414; 285/45; 285/302

[58] Field of Search ..... 175/305, 306, 320, 321, 175/322, 414, 415, 417; 285/45, 302

[56] References Cited

U.S. PATENT DOCUMENTS

| | | | |
|---|---|---|---|
| 2,756,022 | 7/1956 | Sturgeon | 285/302 |
| 3,013,793 | 12/1961 | Howell et al. | 175/321 |
| 3,554,306 | 1/1971 | Wilburn | 175/417 |
| 4,043,409 | 8/1977 | Walter | 175/414 |
| 4,632,195 | 12/1986 | Emmerich | 175/320 |

FOREIGN PATENT DOCUMENTS

| | | | |
|---|---|---|---|
| 65857 | 2/1914 | Austria | 175/305 |
| 552305 | 3/1943 | United Kingdom | 175/320 |
| 159736 | 7/1957 | Sweden | 175/306 |

*Primary Examiner*—Stephen J. Novosad
*Assistant Examiner*—Terry Lee Melius

[57] ABSTRACT

The present invention relates to a seat protector device of the type which may be employed with drill rods for transmission of thrust from a driving member to a driven member. More specifically, the invention relates to an improved drill rod system for earth drilling where the rod also provides an axial passageway for a fluid to carry drill cuttings away from the cutting area. The seat protector device of the present invention may be detachably inserted between one or more drill rod sections and/or between one of the drill rods and the drill bit and/or between one of the drill rod members and the driving chuck for transmitting thrust load forces while simultaneously reducing damage and/or wear between the component parts.

4 Claims, 1 Drawing Sheet

BIT SEAT PROTECTOR DEVICE FOR DRILLING SYSTEMS OR THE LIKE

TECHNICAL FIELD

The present invention relates to a seat protector device of the type which may be employed with drill rods for transmission of thrust from a driving member to a driven member. More specifically, the invention relates to an improved drill rod system for earth drilling where the rod also provides an axial passageway for a fluid to carry drill cuttings away from the cutting area. The seat protector device of the present invention may be detachably inserted between one or more drill rod sections and/or between one of the drill rods and the drill bit and/or between one of the drill rod members and the driving chuck for transmitting thrust load forces while simultaneously reducing damage and/or wear between the component parts.

BACKGROUND OF THE INVENTION

Heretofore, conventional type drill rod systems have generally utilized a plurality of hollow drill rod members which are typically coupled together in end-to-end relation for removing particulate materials away from the cutting area upon application of a vacuum to the system. In such systems, a drill bit is detachably connected adjacent the working end of the last drill rod and typically has dust-collection openings formed therein which communicate with the interior of the hollow drill rods for removing the drill cuttings from the drill area by the provision of a negative pressure differential between the interior and exterior of the drill rod members upon application of a vacuum to the system, as aforesaid. The other end of the drill rod system is typically connected to a power driven chuck for rotating the drill rod system in a manner known in the art.

In prior drilling systems severe problems have developed in respect to damage and/or wear between the coupled and abutting drill rod members and/or between one of the drill rod members and the drive chuck and/or drill bit. Particular problems have been encountered in respect to the driving connection between the respective drill rod member and the drill bit due to the relatively heavy thrust load forces transmitted from the drill rods to the cutting bit. These load forces are developed not only from a rotary action on the drill bit but also due to the axial, reciprocating action on the drill rod members which imparts a "hammering" action on the drill bit. For example, it has been found that a severe axial thrust force acts to drive the drill rod in some instances into the hollow body of the drill bit causing splitting of the drill bit and/or resulting in an actual "welding" of the drill bit to the associated drill rod. In addition, it has been found that as the component parts wear down adjacent the areas of their connections to one another so that the system tends to lose its rigidity resulting in a "wobbling" action rendering it difficult for the operator to carry out the drilling operation. Such loosening between the component parts of the system not only renders the drilling operation difficult but also tends to creat a hazardous condition for the operator especially because of the relatively high thrust loads necessary for drilling hard strata.

SUMMARY OF THE INVENTION

The present invention provides a new and improved drill rod system that incorporates one or more seat protector devices for reducing damage and/or wear between the components parts thereby prolonging the life of the system. In the invention, the system comprises one or more hollow drill rod members which detachably mounts, at one end, a drill bit and that is adapted at the other end to be coupled to one or more other hollow drill rod members and/or to a power driven chuck for rotating the system. One or more seat protector devices are detachably disposed between a drill rod member and the drill bit and/or between interconnected drill rod members with each device including a generally flat body element having a centrally disposed opening therein. The body element is made from a deformable material having a hardness which is less than that of the material of the drill bit or drill rod members. The deformable material is selected from the group consisting of a malleable metal alloy material, an elastomeric material or a polymeric material. In one form, the element may be of a composite construction having one layer of the deformable metal alloy material and one or more layers of the elastomeric or polymeric material adhesively secured to one or either side thereof. A central opening in the element is dimensioned so as be the same or slightly larger than the corresponding cross-sectional dimension of the opening in the associated hollow drill rod member to enable an unobstructed flow of particulate material through the drill rod system.

DESCRIPTION OF THE PREFERRED EMBODIMENT

Figure 1:
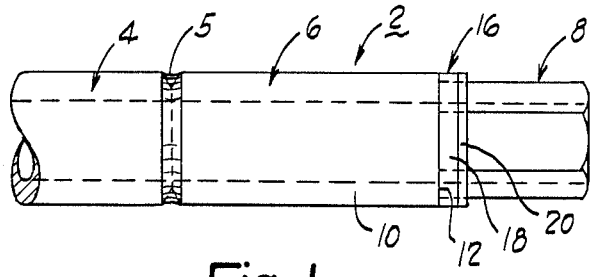
FIG. 1 is a fragmentary, side elevation view illustrating one embodiment of the seat protector device for a drill rod system.
Figure 2:
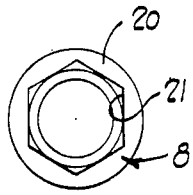
FIG. 2 is an end view looking from the right hand side of FIG. 1.

Referring now again to the drawings and in particular to FIGS. 1, 2, 7 and 8 thereof, there is illustrated a hollow tubular drill rod member 4 which may be welded, as at 5, to a drill bit adapter 6. The adapter 6 includes an integral male adapter portion 8 which may be of a hexagonal configuration for detachable securement to a drill bit member (not shown). For example, reference is made to U.S. Pat. No. 3,554,306 relative to such drill rod system and which disclosure is incorporated herein by reference. In U.S. Pat. No. 3,554,306 the drill bit 32 includes a shank 30 which fits into the hexagonal drill rod member 22. In the present invention, the conventional type drill bit 32 has a hexagonal cavity, as illustrated at element 17 in U.S. Pat. No. 4,492,278 which is incorporated herein by reference. Accordingly, in the present invention, the male portion 8 is of a hexagonal configuration, in vertical cross-section, so as to be received in the corresponding hexagonal shank of the drill bit.

Figure 3:
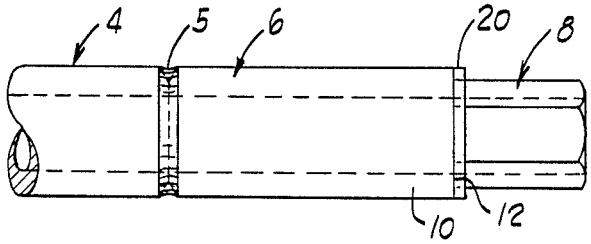
FIG. 3 is a fragmentary, side elevation view illustrating another embodiment of the seat protector device in a drill rod system in accordance with the invention.
Figure 4:
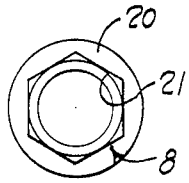
FIG. 4 is an end view looking from the right hand side of FIG. 3.
Figure 5:
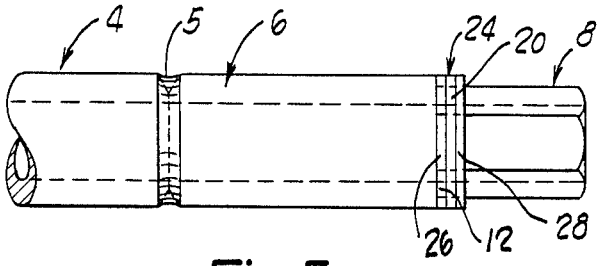
FIG. 5 is a fragmentary, side elevation view of a further embodiment of the seat protector device for use in a drill rod system in accordance with the invention.
Figure 6:
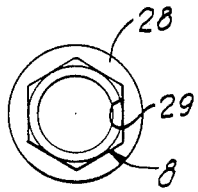
FIG. 6 is an end view looking from the right hand side of FIG. 5.
Figure 7:
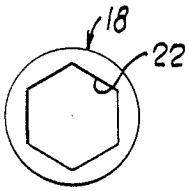
FIG. 7 is a front elevation view of a portion of the seat protector device illustrated in FIG. 1.
Figure 8:
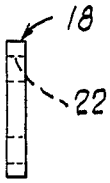
FIG. 8 is an end view looking from the right hand side of FIG. 7.
Figure 9:
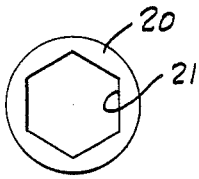
FIG. 9 is an elevation view illustrating the seat protector device of FIG. 3.
Figure 10:
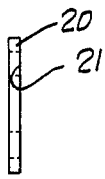
FIG. 10 is an end view looking from the right hand side of FIG. 9.
Figure 11:
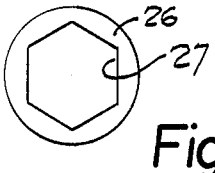
FIG. 11 is a front elevation view of the seat protector device illustrated in FIG. 5.
Figure 12:
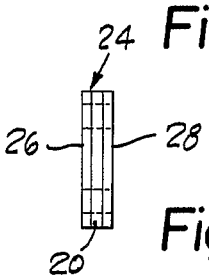
FIG. 12 is an end view looking from the right hand side of FIG. 11.

As best illustrated in FIG. 1, the juncture of the cylindrical body 10 of the adapter 6 with the male portion 8 provide a hexagonal shoulder or seat portion, as at 12. The seat portion 12 is adapted to receive the corresponding peripheral end surface of the shank of the drill bit upon insertion of the male portion 8 into the hexagonal cavity or bore 17, as illustrated in FIG. 3 of aformentioned U.S. Pat. No. 4,492,278. Accordingly, there is provided a drill rod system which may incorporate any number of drill rod members 4 which are attached in end-to-end relation via the drill bit adapter 6 with the number of adapters depending upon the number of drill rod members necessary to complete the length of the system.

Now in the invention, there is provided a seat protector device, designated generally at 16, that detachably mounts on the shoulder or seat portion 12. In the embodiment illustrated, the protector device 16 is of a composite construction including an inner layer of resilient polymeric material 18 that may be adhesively bonded to an outer layer 20 of a malleable metal alloy material. Preferably, the resilient polymer is a high strength plastic material. The malleable metal alloy material is preferably an alloy steel having AISI compositions generally including, 8620, 4140, and 4340. Preferably, the thickness of the resilient polymeric material 18, in the embodiment illustrated, is more than twice the thickness of the malleable metal material 20. By this arrangement, the composite protector device 16 acts as a deformable element which protects the seat for the drill bit. Moreover, the outer deformable metallic layer 20 provides, in effect, the seat for the drill bit.

In the invention, the malleable metal material has a preferred hardness of between 10 to 20 (Rockwell), and with the hardness of the body being substantially greater than 20 and in excess of 40 (Rockwell). Accordingly, it is preferred that the malleable material have a metal softness of at least one-half that of the bit body (i.e. 2:1), and up to a ratio of 4:1 or greater to provide the necessary malleability (metal flow) characteristics for minimizing wear in accordance with the invention.

In the invention, it will be understood that the pinning rod system may include drill rod members having not only a hexagonal cross-sectional configuration but other polygonal configurations and also circular configurations, as disclosed in the patents cited of reference in aforementioned U.S. Pat. No. 3,554,306. Accordingly, the seat protector device, as at 16, may have not only a hexagonal opening, as at 22, (FIG. 7) but may be of any internal configuration to accommodate corresponding cross-sectional configruation of the seat to be protected.

In FIGS. 3, 4, 9 and 10 there is illustrated another embodiment of the system of the present invention wherein like parts are identified by like reference numerals. In this form, however, the seat protector device includes only a single malleable metal alloy layer 20 that is of a generally flat construction having the hexagonal opening, as at 21, therein to accommodate the corresponding cross-sectional configuration of the male insert 8.

In FIGS. 5, 6, 11 and 12 there is illustrated a still further modified embodiment of the present invention wherein like parts are designated by like reference numerals. In this form, the seat protector device, designated generally at 24, is of a composite construction including an inner malleable metal layer 20 which is sandwiched between two outer layers 26 and 28 made from a resilient polymeric material. Here again, the device is of a generally flat construction having a hexagonal opening to accommodate the cross-sectional shape of the hexagonal male insert 8, and with a circular outer configuration so as to correspond to the diameter of the drill bit adapters 6.

Other advantages and objects of the present invention will become apparent when the foregoing description and accompanying drawings are taken in conjunction with the appended claims.

I claim:

1. A drill rod system of the type for mounting a drill bit for rotary drilling and for removing particulate materials by means of a vacuum, said system comprising at least one hollow drill rod member adapted for receiving drilled particulate materials therethrough, one end of said drill rod member adapted to detachably mount a drill bit having a head portion and an integral male socket portion adapted to be interiorly mounted within said drill rod member, said head and socket portions together defining a peripheral shoulder surface adapted for thrust bearing engagement on the confronting surface of said drill rod member, and a deformable protector element adapted to be disposed between said shoulder surface portion and the confronting surface of said drill rod member for receiving axial thrust load forces from said drill bit, said protector element being of a generally flat construction having an upper planar surface and a lower planar surface separated by a generally uniform thickness and being of a generally ring-like configuration confined by a central opening, the opening being sized to receive said male socket portion, and said protector element being made form a deformable material having a lesser hardness as compared to the material of said drill bit and said drill rod members; and wherein said protector element is of a composite construction including at least one flat layer of a malleable metal alloy material and a second flat adhesively bonded layer of a polymeric material, the composite protector element being of uniform thickness.

2. A drill rod system in accordance with claim 1, wherein said protector element is of a composite construction including an intermediate layer of a malleable metal alloy material with outer layers of polymeric material adhesively bonded on opposed sides thereof.

3. A drill rod system in accordance with claim 1, including at least one additional drill rod member detachably coupled via a coupling member to said first mentioned drill rod member, said coupling member including a body portion and an integral male coupling portion which together define a supporting shoulder surface, and one of said protector elements being disposed between said supporting surface and the confronting surface of said first mentioned and said second mentioned drill rod members.

4. A drill rod system in accordance with claim 3, including a plurality of said drill rod members operably coupled together by means of a series of said coupling members for concurrent rotation of said drill bit, and one of said protector elements being disposed in thrust load bearing relation between adjacent of said drill rod members.

* * * * *